US006446604B1

(12) United States Patent
Guentert et al.

(10) Patent No.: US 6,446,604 B1
(45) Date of Patent: Sep. 10, 2002

(54) RADIAL PISTON PUMP FOR HIGH PRESSURE FUEL SUPPLY

(75) Inventors: Josef Guentert, Gerlingen; Bernd Streicher, Filderstadt; Kasim-Melih Hamutcu, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,397

(22) PCT Filed: Nov. 5, 1998

(86) PCT No.: PCT/DE98/03222

§ 371 (c)(1),
(2), (4) Date: Aug. 25, 2000

(87) PCT Pub. No.: WO99/36697

PCT Pub. Date: Jul. 22, 1999

(30) Foreign Application Priority Data

Jan. 16, 1998 (DE) ..... 198 01 398

(51) Int. Cl.[7] ..... F02M 41/00; F04B 1/04

(52) U.S. Cl. ..... 123/456; 123/495; 417/273; 92/72

(58) Field of Search ..... 123/495, 450, 123/456; 417/269, 273, 286; 92/72

(56) References Cited

U.S. PATENT DOCUMENTS 4,944,493 A * 7/1990 Handy ..... 256/23
4,957,419 A * 9/1990 Rascov ..... 417/273
5,050,558 A * 9/1991 Brunel et al. ..... 123/450
5,311,850 A * 5/1994 Martin ..... 123/456
5,364,234 A * 11/1994 Eickmann ..... 417/273
5,404,855 A * 4/1995 Yen et al. ..... 123/446
5,634,777 A * 6/1997 Albertin et al. ..... 417/273

FOREIGN PATENT DOCUMENTS

EP 0816675 A2 * 1/1998
GB 2160596 * 12/1985

* cited by examiner

*Primary Examiner*—Carl S. Miller
(74) *Attorney, Agent, or Firm*—Ronald E. Greigg

(57) ABSTRACT

The invention relates to a radial piston pump for high-pressure fuel supply in fuel injection systems of internal combustion engines, in particular in a common rail injection system. The piston pump has a drive shaft which is eccentrically supported in a pump housing and on which a ring is slidingly supported. The ring cooperates with a plurality of pistons, disposed radially relative to the drive shaft in a respective cylinder chamber. The pistons are movable radially back and forth in the respective cylinder chamber by rotation of the drive shaft. To increase the efficiency of the engine, the cylinder chambers are filled with less fuel when demand drops. In this so-called partial element filling, in which a plate is retained in contact with a polygonal ring, increased wear and damage are prevented. The wear is brought about by a guide device which prevents rotation of the ring about its own axis.

19 Claims, 3 Drawing Sheets

RADIAL PISTON PUMP FOR HIGH PRESSURE FUEL SUPPLY

PRIOR ART

The invention relates to a radial piston pump for high-pressure fuel supply in fuel injection systems of internal combustion engines, in particular in a common rail injection system. A drive shaft which is eccentrically supported in a pump housing and on which a ring is slidingly supported that cooperates with a plurality of pistons, disposed radially relative to the drive shaft in a respective cylinder chamber. The pistons are movable radially back and forth in the respective cylinder chamber by rotation of the drive shaft.

In one such radial piston pump, braced on the inside, the base of each of the pistons has contact with the ring supported on the drive shaft. Because of the eccentricity of the drive shaft, the pistons are successively set into a reciprocating motion. The stroke of the pistons is constant and corresponds to twice the amount of the eccentricity of the drive shaft.

To increase the efficiency of the engine, it has been proposed that the cylinder chambers be filled with less fuel as demand drops.

An object of the invention is to enable partial filling of the cylinder chambers of the radial piston pump. Wear of the individual components is to be minimized, and damage during operation is to be averted. In particular, the radial piston pump of the invention should withstand a pump pressure of up to 2000 bar in the feeding direction.

A radial piston pump for a high-pressure fuel supply in fuel injection systems of internal combustion engines, in particular in a common rail injection system, has drive shaft which is eccentrically supported in a pump housing and on which a ring is slidingly supported that cooperates with a plurality of pistons. The pistons are disposed radially relative to the drive shaft in a respective cylinder chamber. The pistons are movable radially back and forth in the respective cylinder chamber by rotation of the drive shaft, this object is attained in that a guide device prevents rotation of the ring its about its own axis. Within the context of the present invention, it has been found that the increased wear and damage in conventional radial piston pumps can be ascribed to rotation of the ring about its own axis. This rotation is prevented by the guide device.

One particular version of the invention is characterized in that the guide device has a protrusion, which extends at least partly parallel to the axis of rotation of the drive shaft and protrudes into an indentation whose dimensions are greater than those of the protrusion. The protrusion can be embodied either on the ring or on the pump housing. In the first case, the associated indentation is provided in the pump housing and in the second case it is provided in the ring. The protrusion can move in the transverse direction only as far as the dimensions of the indentation allow. This advantageously assures that the motions of the ring in the circumferential direction as limited.

A further special version of the invention is characterized in that the protrusion is embodied on the ring, and the indentation is embodied in the pump housing. The converse case is also possible, as noted above, but in that case the size of the indentation is limited to the dimensions of the ring. In the pump housing, conversely, adequate space for the indentation is available.

A further special version of the invention is characterized in that the protrusion and the indentation each take the form of a cylinder, whose longitudinal axis is parallel to the axis of the drive shaft. In the context of the present invention, it has been found that the ideal course of motion of the ring is a circle. It is accordingly advantageous if both the indentation and the protrusion are cylindrical. This reduces the motion of the ring in the circumferential direction to the minimum required by the eccentricity of the drive shaft.

A further special version of the invention is characterized in that the diameter of the indentation is equivalent to twice the sum of the eccentricity of the drive shaft and the radius of the protrusion. A circle with this diameter corresponds to the ideal guide path of the ring.

A further special version of the invention is characterized in that the diameter of the indentation is somewhat greater than twice the sum of the eccentricity of the drive shaft and the radius of the protrusion. This assures that the ring can move on its ideal path, without the protrusion and the indentation being in contact with one another. This has the advantage of reducing wear from friction. The protrusion does not come into contact with the indentation until the ring is no longer moving on its ideal path.

A further special version of the invention is characterized in that the protrusion is a pin, which is secured in a bore in the pump housing, and that the indentation is a bore. This is one of many variants for the design of the protrusion and the indentation. This variant has the advantage that it can be produced simply and economically. It furthermore allows the present invention to be applied to known radial piston pumps.

A further special version of the invention is characterized in that the indentation is embodied annularly. The protrusion protrudes into the annular indentation and can thus move only in the circumferential direction of the indentation. Consequently, the ring can execute only such motions as well. In this way, compulsory guidance of the ring along its ideal path of motion is advantageously assured.

A further special version of the invention is characterized in that the indentation is a bore in which a pin is secured. In this way, the annular shape of the indentation can be achieved simply and economically. Preferably, the diameter of the pin is somewhat less than twice the difference between the eccentricity and the radius of the protrusion.

A further special version of the invention is characterized in that radially to the drive shaft, at least three pistons are disposed, and on the end toward the drive shaft of each piston a plate is retained by a cage and is in contact with a flat face which is embodied on the ring. In a radial piston pump with a polygonal ring, the guide device of the invention has an especially advantageous effect. In experiments that have been performed with such a pump, it has been found that the ring can tilt about its axis if the cylinder chambers are not completely filled. This tilting is ascribed to the fact that in partial element filling, not all the plates rest permanently firmly enough on the ring. The tilting engenders impact forces on the plate that are transmitted to the cage and the piston. The resultant moments then cause damage to the affected components.

The guide device of the invention can in the simplest case comprise at least one guide piston, which in addition to the pistons already present is disposed radially to the drive shaft and rests on the ring.

Further advantages, characteristics and details of the invention will become apparent from the dependent claims and the ensuing description, in which one exemplary embodiment is described in detail in conjunction with the drawing. The characteristics recited in the claims and mentioned in the description can each be essential to the invention individually or in arbitrary combination. One way of embodying the claimed invention is described below in detail in conjunction with the drawing.

DETAILED DESCRIPTION

Figure 1:
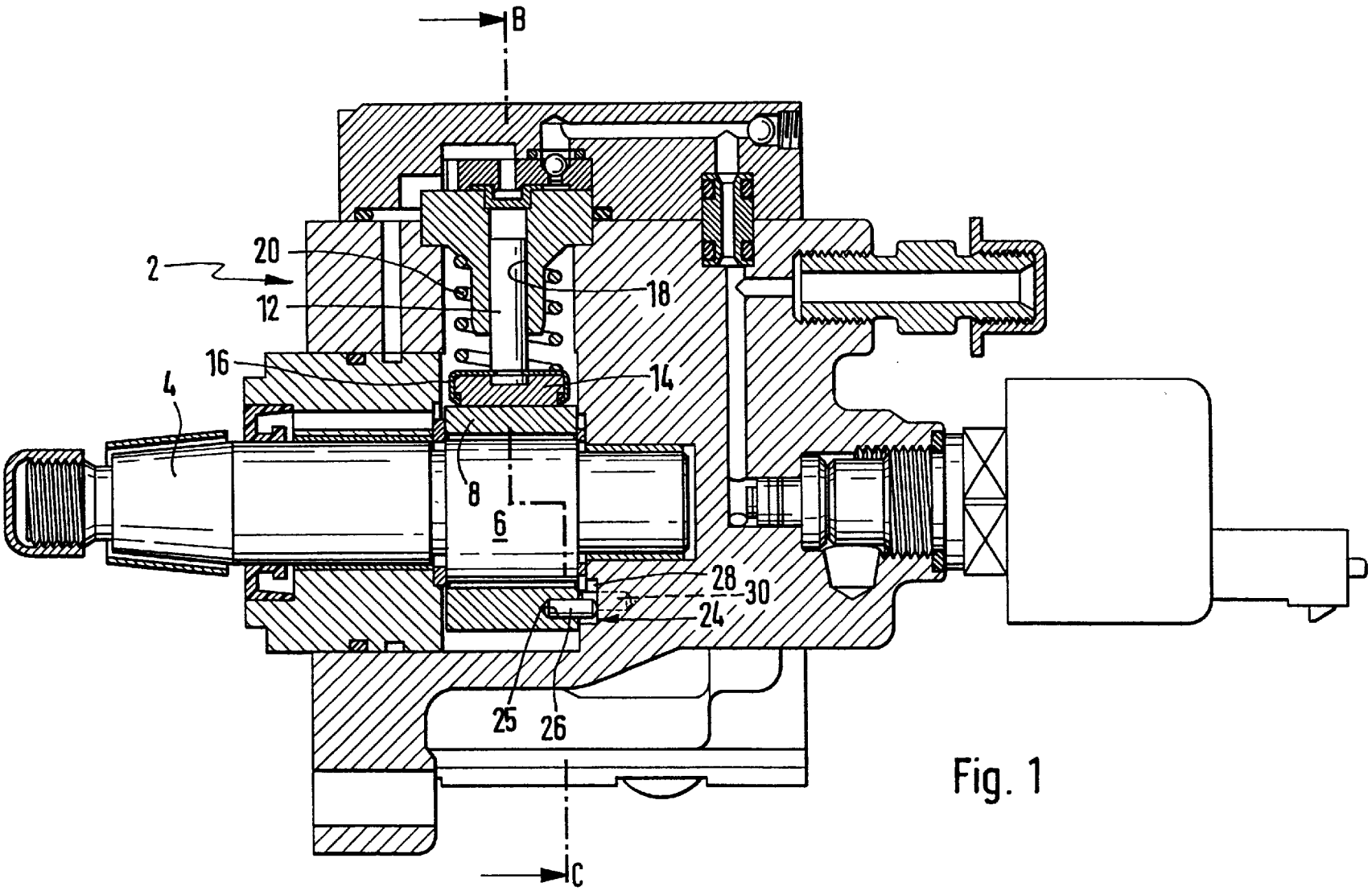
FIG. 1 shows a sectional view of a radial piston pump of the invention, the section being taken along the line D–E in FIG. 2.
Figure 2:
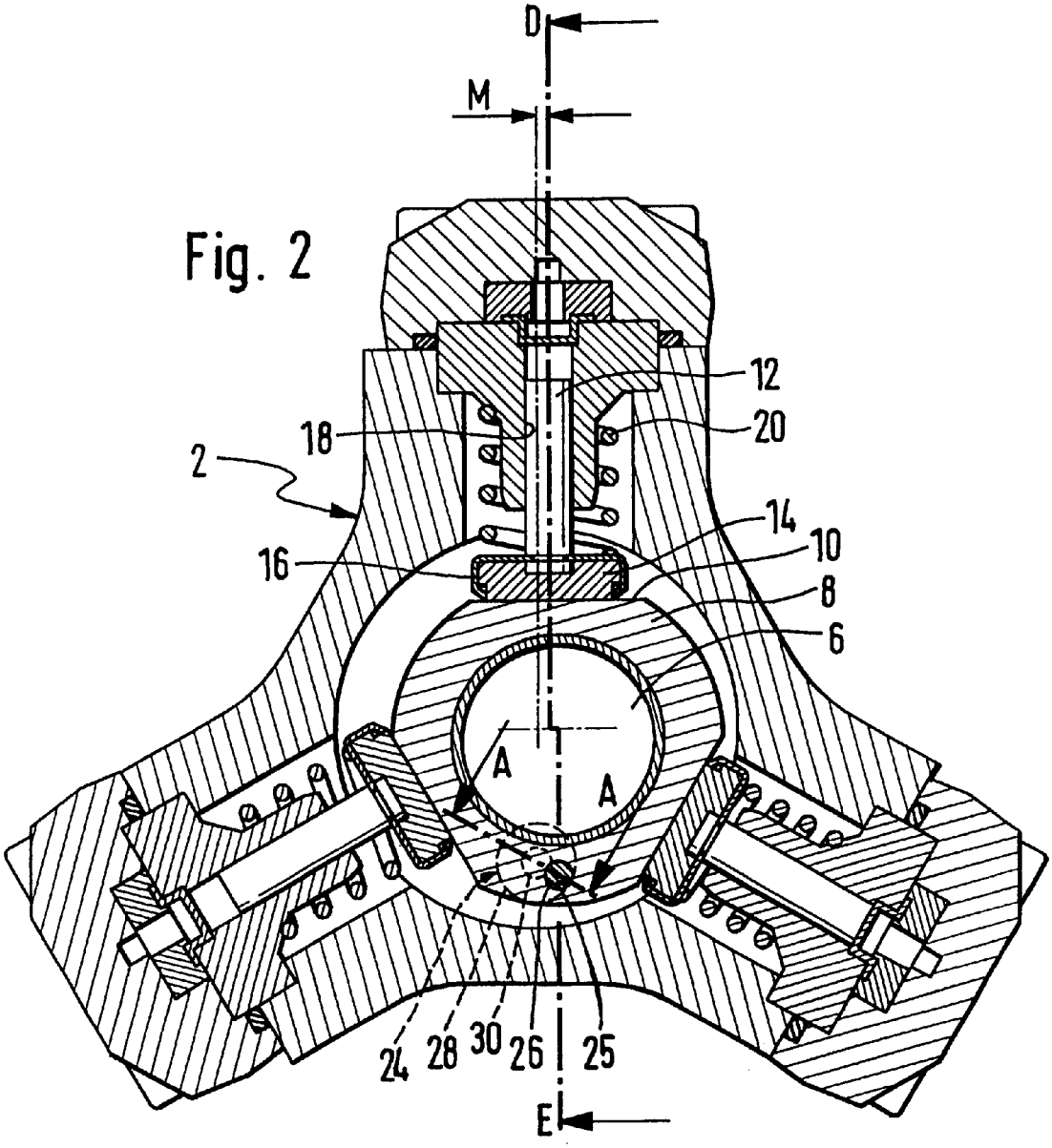
FIG. 2 shows a section along the line B–C through the radial piston pump of FIG. 1.

FIGS. 1 and 2 show a radial piston pump for a high-pressure fuel supply in fuel injection systems of internal combustion engines. The radial piston pump is equipped with an integrated demand quantity regulation system. The fuel delivery and the dimensioning are done via a metering unit, not shown.

The radial piston pump of the invention is used in particular in common rail injection systems to supply fuel to diesel engines. The term "common rail" means the same as "common line" or "common distributor strip". In contrast to conventional high-pressure injection systems, in which the fuel is fed to the individual combustion chambers via separate lines, the injection nozzles in common rail injection systems are supplied from a common line.

The radial piston pump shown in FIGS. 1 and 2 includes a drive shaft 4, supported in a pump housing 2, with an eccentrically embodied shaft portion 6. On the eccentric shaft portion 6, a ring 8 is provided, relative to which the shaft portion 6 is rotatable. The ring 8 includes three flat faces 10, offset by 120° each from one another, against each of which a piston 12 is braced. The pistons 12 are received in a respective cylinder chamber 18 such that they can be moved back and forth radially to the drive shaft 4. The base of each piston 12 is embodied as a plate 14, which rests on the respective flat face 10 of the ring 8. Each plate 14 is secured by a cage 16 to the piston 12 and is pressed by a spring 20 against the ring 8.

Figure 3:
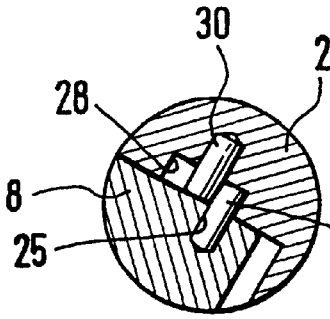
FIG. 3 shows a fragmentary view of a section along the line A—A in FIG. 2.

Rotation of the ring is reduced to a minimum by a guide device 24. The guide device 24 shown as an example in FIGS. 1 and 2, as can be seen most clearly from the fragmentary view of FIG. 3, includes a bore 25, which is provided in the ring and in which a pin 26 is secured.

The pin 26 protrudes into a further bore 28, which is provided in the housing 2, and whose diameter is greater than that of the pin 26. A further pin 30 is secured centrally in the bore 28 in the housing 2. The dimensions of the bores and the pins are selected such that the difference between the diameter of the bore 28 in the housing 2 and the diameter of the pin 30 in the housing 2 is somewhat greater than the diameter of the pin 26 in the ring 8. As a result, the pin 26 in the annular chamber can move around the pin 30 in the bore 28 in the housing 2 along a circular path.

Figure 4:
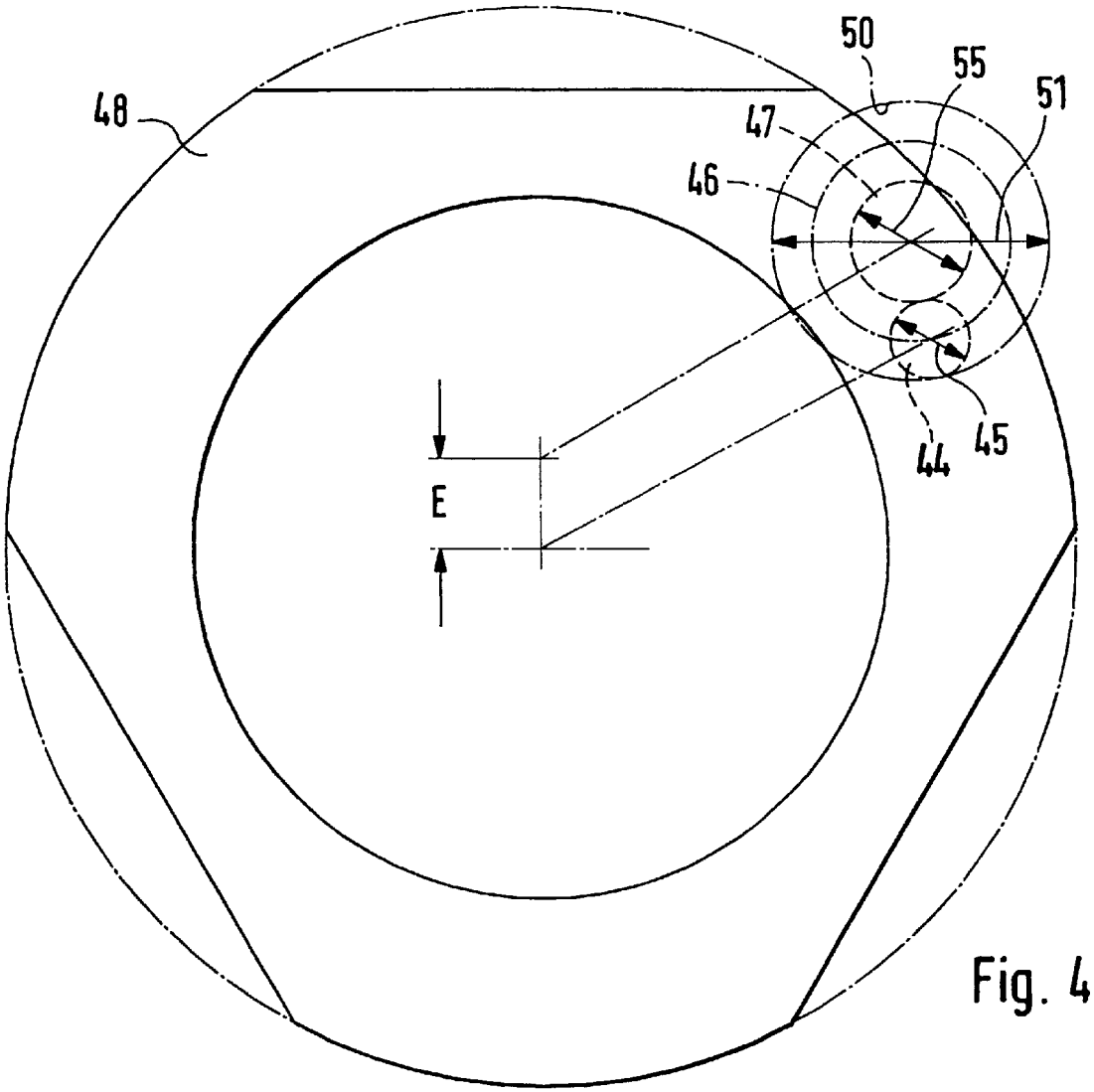
FIG. 4 shows the ideal path of motion of a ring and also shows a guide device of the present invention.

In FIG. 4, the ideal path of motion 46 of a polygonal ring 48 is shown. As noted above, the polygonal ring 48 is slidingly supported on an eccentrically embodied drive shaft, not shown in FIG. 4. The eccentricity is indicated by E in FIG. 4. A pin 44 with a diameter 45 is secured in the ring 48. The pin 44 protrudes with its free end into a bore 50, which is provided in the housing, not shown, and which has a diameter 51. Disposed in the center of the bore 50 is a pin 47, which is fixed in the housing and whose diameter is marked at 55.

In the ideal case, the circle 46 has a diameter that is equivalent to twice the eccentricity E, or in other words the piston stroke. The diameter 51 of the bore 50 is ideally equivalent to the sum of the piston stroke and the diameter of the pin 44 in the ring 48. In practice, the ideal dimensions are also affected by the usual production variations. Furthermore, the play between the drive shaft and the ring must be taken into account.

In FIG. 2, it is shown that a center offset M is provided, to minimize the load on the pistons 12. The invention now has not only the advantage that the torque of the ring 8 is absorbed by the pin 26, but also the advantage that the center offset M can be dispensed with. As a consequence, the same pump housing can be used for both counterclockwise and clockwise rotation of the radial piston pump of the invention. This reduces the costs and makes logistics simpler.

The present invention furthermore has the advantage that the spring 20, which presses the plate 14 against the ring 8, is relieved. This enhances the durability of the spring 20. Furthermore, breakage of the cage 16 that retains the plate 14 on the piston 12 is prevented. This facilitates quality assurance with a view to zero errors. Finally, it will be noted that even for partial filling, no other center offset M of the piston 12 is needed.

The foregoing relates to a preferred exemplary embodiments of the invention, it being understood that other variants and embodiments thereof are possible within the spirit and scope of the invention, the latter being defined by the appended claims.

We claim:

1. A radial piston pump for high-pressure fuel supply in fuel injection systems of internal combustion engines, comprising a common rail injection system, having a drive shaft (4) which is eccentrically supported in a pump housing (2) and on which a ring (8, 48) is slidingly supported that cooperates with a plurality of pistons (12) disposed radially relative to the drive shaft (4) in a respective cylinder chamber (18), the pistons are movable radially back and forth in the respective cylinder chamber (18) by rotation of the drive shaft (4), a guide device (24) for the ring (8), the guide device (24) has a protrusion (26, 44), which extends at least partly parallel to the axis of rotation of the drive shaft (4) and protrudes into an indentation (28, 50), whose dimensions are greater than those of the protrusion (26, 44), and which is annularly embodied.

2. The radial piston pump of claim 1, in which the protrusion (26, 44) is embodied on the ring (8, 48), and the indentation (28, 50) is embodied in the pump housing (2).

3. The radial piston pump of claim 1, in which the protrusion (26, 44) and the indentation (28, 50) each take the form of a cylinder, whose longitudinal axis is parallel to the axis of the drive shaft (4).

4. The radial piston pump of claim 2, in which the protrusion (26, 44) and the indentation (28, 50) each take the form of a cylinder, whose longitudinal axis is parallel to the axis of the drive shaft (4).

5. The radial piston pump of claim 3, in which the diameter of the indentation (28, 50) is equivalent to twice a sum of the eccentricity (E) of the drive shaft (4) and a radius of the protrusion (26, 44).

6. The radial piston pump of claim 4, in which the diameter of the indentation (28, 50) is equivalent to twice a sum of the eccentricity (E) of the drive shaft (4) and a radius of the protrusion (26, 44).

7. The radial piston pump of claim 3, in which the diameter of the indentation (28, 50) is somewhat greater than twice a sum of the eccentricity (E) of the drive shaft (4) and a radius of the protrusion (26, 44).

8. The radial piston pump of claim 4, in which the diameter of the indentation (28, 50) is somewhat greater than twice a sum of the eccentricity (E) of the drive shaft (4) and a radius of the protrusion (26, 44).

9. The radial piston pump of claim 1, in which the protrusion is a pin (26, 44), which is secured i n a bore (25) in the pump housing (2), and that the indentation is a bore (28, 50).

10. The radial piston pump of claim 2, in which the protrusion is a pin (26, 44), which is secured in a bore (25) in the pump housing (2), and that the indentation is a bore (28, 50).

11. The radial piston pump of claim 3, in which the protrusion is a pin (26, 44), which is secured in a bore (25) in the pump housing (2), and that the indentation is a bore (28, 50).

12. The radial piston pump of claim 5, in which the protrusion is a pin (26, 44), which is secured in a bore (25) in the pump housing (2), and that the indentation is a bore (28, 50).

13. The radial piston pump of claim 7, in which the protrusion is a pin (26, 44), which is secured in a bore (25) in the pump housing (2), and that the indentation is a bore (28, 50).

14. The radial piston pump of claim 1, in which the indentation (28, 50) is embodied annularly.

15. The radial piston pump of claim 2, in which the indentation (28, 5b) is embodied annularly.

16. The radial piston pump of claim 3, in which the indentation (28, 50) is embodied annularly.

17. The radial piston pump of claim 1, in which radially to the drive shaft (4), at least three pistons (12) are disposed, and on an end toward the drive shaft (4) of each piston (12) a plate (14) is retained by a cage (16) and is in contact with a flat face (10) which is embodied on the ring (8, 48).

18. The radial piston pump of claim 2, in which radially to the drive shaft (4), at least three pistons (12) are disposed, and on an end toward the drive shaft (4) of each piston (12) a plate (14) is retained by a cage (16) and is in contact with a flat face (10) which is embodied on the ring (8, 48).

19. The radial piston pump of claim 3, in which radially to the drive shaft (4), at least three pistons (12) are disposed, and on an end toward the drive shaft (4) of each piston (12) a plate (14) is retained by a cage (16) and is in contact with a flat face (10) which is embodied on the ring (8, 48).

* * * * *